US005791795A

United States Patent [19]

Thompson

[11] Patent Number: 5,791,795

[45] Date of Patent: Aug. 11, 1998

[54] HOT STAMP IMPRINITING SYSTEM WITH BACKUP PAD ASSEMBLY

[75] Inventor: James A. Thompson, Downers Grove, Ill.

[73] Assignee: Illinois Tool Works Inc., Glenview, Ill.

[21] Appl. No.: 725,932

[22] Filed: Oct. 7, 1996

[51] Int. Cl.[6] ..... B41J 11/08

[52] U.S. Cl. ..... 400/656; 400/654

[58] Field of Search ..... 101/287, 290, 101/291, 298, 316; 400/661.1, 662, 656, 657, 654, 655

[56] References Cited

U.S. PATENT DOCUMENTS

| | | | |
|---|---|---|---|
| 2,881,893 | 4/1959 | Metzner | 400/616.3 |
| 4,928,134 | 5/1990 | Hasegawa et al. | 400/662 |
| 4,957,378 | 9/1990 | Shima | 400/662 |
| 4,981,381 | 1/1991 | Murata | 400/662 |
| 4,984,917 | 1/1991 | Hauslaib et al. | 400/656 |

FOREIGN PATENT DOCUMENTS

| | | | |
|---|---|---|---|
| 34 06 836 | 8/1984 | Germany | 400/662 |
| 60-162672 | 8/1985 | Japan | 400/662 |
| 6-1209177 | 9/1986 | Japan | 400/662 |
| 61-280962 | 12/1986 | Japan | 400/662 |
| 63-072567 | 4/1988 | Japan | 400/662 |
| 2-134267 | 5/1990 | Japan | 400/662 |
| 2-274575 | 11/1990 | Japan | 400/662 |
| 3-256764 | 11/1991 | Japan | 400/656 |

*Primary Examiner*—Edgar S. Burr
*Assistant Examiner*—Daniel J. Colilla
*Attorney, Agent, or Firm*—John P. O'Brien

[57] ABSTRACT

An imprinting system with a typeface for transferring ink from an inked ribbon onto a substrate including a first resilient member having an exposed surface located opposite the typeface, and the inked ribbon and substrate disposeable between the typeface and the first resilient member. The first resilient member is mounted on a first rigid member which is supported by a second resilient member supported by a second rigid member. The first resilient member has a durometer hardness greater than a hardness of the second resilient member, wherein the second resilient member is compressible between the first rigid member and the second rigid member to absorb shock from the typeface impacting against the first resilient member during imprinting.

12 Claims, 1 Drawing Sheet

HOT STAMP IMPRINITING SYSTEM WITH BACKUP PAD ASSEMBLY

CROSS-REFERENCE TO RELATED APPLICATIONS

The present application is related to the following several co-pending applications U.S. application Ser. No. 08/725,932, filed 7 Oct. 1996 and entitled "Hot Stamp Imprinting System With Locking Cam Reel Hubs", U.S. application Ser. No. 08/725,928, filed 7 Oct. 1996 and entitled "Hot Stamp Imprinting System With Latchable Ink Ribbon Cassette and Handle", and U.S. application Ser. No. 08/725,929, filed 7 Oct. 1996 and entitled "Hot Stamp Imprinting System With Variable Typeholder", all assigned to the common assignee of the present invention and incorporated herein by reference.

BACKGROUND OF THE INVENTION

The invention relates generally to printing systems, and more particularly to hot stamp imprinters having a print head with a typeface cooperateable with a backup pad assembly for transferring ink from an inked ribbon onto a substrate.

Hot stamp imprinter systems are used often by the packaging industry in labeling and packaging production lines to produce high quality imprints of lot numbers, expiration dates, production codes, and other variable information on a variety of substrates including labels and packages. Hot stamp imprinter systems, for example, generally include an inked ribbon disposed between a backup pad and a heated print head assembly. And the print head assembly includes a typeholder with typeface having alpha-numeric characters and logos, which is movable toward and away from the backup pad by a cam or pneumatic actuator mechanism. Ink is transferred onto a portion of substrate between the inked ribbon and the backup pad during contact between the inked ribbon and substrate caused by the typeface as the print head applies pressure on the ribbon and substrate against the backup pad. Between imprints, the inked ribbon is advanced from a ribbon supply roll to a ribbon take-up roll to position an unused portion of inked ribbon between the print head assembly and the backup pad for the next imprint. The substrate is also advanced between imprints by a substrate feed mechanism to position an adjacent portion of the substrate between the print head and the backup pad for the next imprint.

Existing backup pads generally include a relatively soft rubber pad mounted on a rigid anvil, which is usually fixedly mounted relative to an actuatable print head. During imprinting, the typeface urges the inked ribbon into contact with the substrate by moving the typeface against the backup pad. The backup pad must therefore be accurately spaced and aligned relative to the typeface to ensure efficient and effective ink transfer onto the substrate. The anvil is often adjustably mounted to a base member, for example, by finely threaded adjustment screws located in three or four comers of the anvil to permit precise spacing and alignment of the backup pad. The spacing and alignment process, however, is time consuming and tedious, and generally requires the skill of a practiced technician. An improperly spaced or aligned backup pad may result in poor or inadequate ink transfer onto all or portions of the substrate, or cause excessive wear on the rubber pad, or cause damage to the ink ribbon or substrate. But many imprinting applications require high quality, consistent ink transfer, to permit imaging of the imprint by optical scanners as in the pharmaceutical and other industries where it is necessary to accurately record imprinted product codes, lot numbers and other data. Accurate backup pad alignment and spacing is thus absolutely essential in many high quality imprinting applications.

The existing rubber pads also have a relatively short life span resulting from a tendency to lose resilience after repetitive compressive impacts by the typeface during imprinting. The impacts are often characterized by forces up to 100 pounds distributed over a relatively small imprint area on the order of 10 square centimeters. This loss of rubber pad resiliency results in deformation of the pad, particularly in areas contacted by the typeface. The rubber pad must therefore be replaced after it loses its resiliency or whenever the typeface is changed to ensure consistent imprint quality. But the rubber pads are costly, and replacement interrupts production. In addition, the deterioration of rubber pad resiliency results in a gradual increase in spacing between the backup pad and the typeface, which must be adjusted occasionally to ensure consistent ink transfer. Rather than endure the tedious adjustment process discussed above, operators generally replace the rubber pad before its useful life has expired, which further increases costs. The adverse effects of typeface impact on the rubber pad are also aggravated by an improperly aligned or spaced backup pad as discussed above.

In view of the discussion above among other considerations, there exists a demonstrated need for an advancement in the art of imprinting systems with backup pads.

It is therefore an object of the invention to provide a novel imprinting system with a backup pad that overcomes problems in the prior art.

It is also an object of the invention to provide a novel imprinting system with a backup pad that requires less frequent alignment and spacing adjustment.

It is another object of the invention to provide a novel imprinting system with a backup pad having an extended useful life span.

It is another object of the invention to provide a novel imprinting system with a backup pad that has a relatively firm typeface contact surface for improved imprinting accuracy and consistency.

It is a further object of the invention to provide a novel imprinting system with a backup pad having an improved ability to absorb impact shock during imprinting and a relatively improved useful life span.

It is a further object of the invention to provide a novel imprinting system with a backup pad having first and second resilient members separated by a rigid member, wherein a hardness of the first resilient member is greater than a hardness of the second resilient member.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
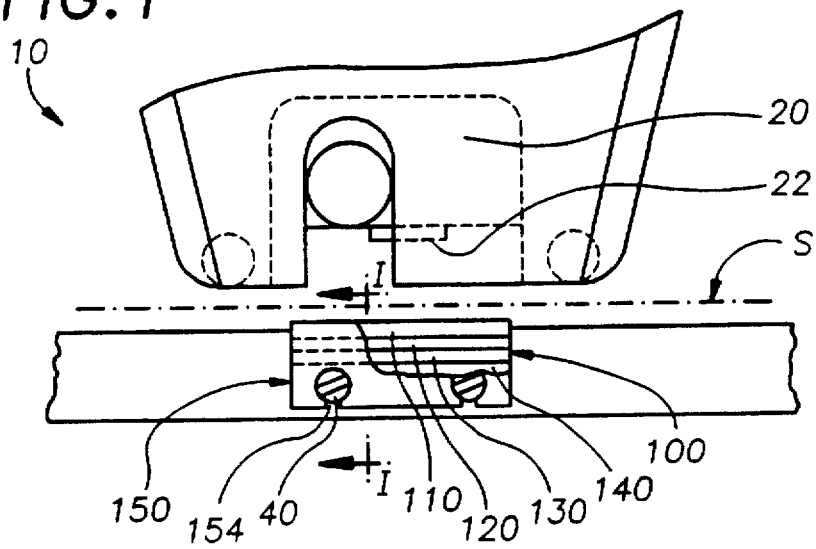
FIG. 1 is a partial sectional view of a print head having a typeface opposing a backup pad assembly mounted on a mounting bar according to an exemplary embodiment of the invention.

The exemplary embodiments of the invention are disclosed in the context of imprinting systems and more particularly hot stamp imprinters with a typeface that cooperates with a backup pad for transferring ink from an inked ribbon onto a substrate, not shown in the drawing. FIG. 1 is a partial sectional view of an imprinting system 10 including generally a print head 20 with a typeface 22 opposing a backup pad assembly 100, wherein the substrate S and inked ribbon, not shown, are interposed between the typeface and the backup pad assembly. The print head 20 is actuateable to move the typeface 22 into contact with the backup pad 100 to compress the interposing inked ribbon and substrate S, which transfers ink onto the substrate.

Figure 2:
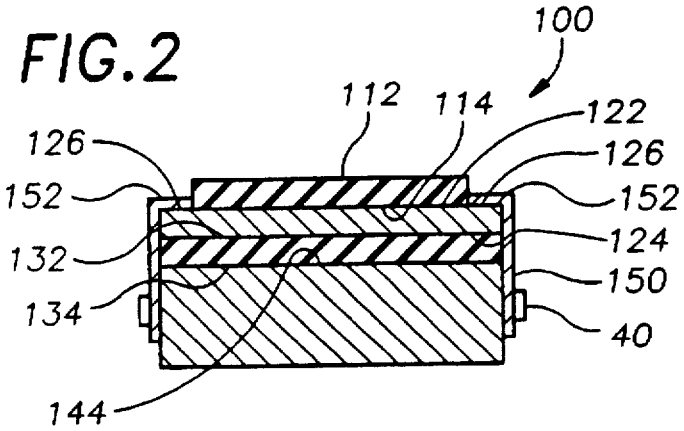
FIG. 2 is a partial sectional view taken along lines I—I of FIG. 1.

FIG. 1 shows the backup pad assembly 100 comprising generally a first resilient plate member 110 supported by a first rigid plate member 120 supported by a second resilient plate member 130 supported by a second rigid plate member 140. And FIG. 2 is a partial sectional view of the backup pad assembly 100 of FIG. 1 showing the first resilient member 110 having an exposed surface 112, which is planar, engageable with the typeface 22, and a substantially opposing mounting surface 114 supportable by a support surface 122 of the first rigid member 120. A mounting surface 124 of the first rigid member 120 is supportable by a support surface 132 of the second resilient member 130, and a mounting surface 134 of the second resilient member 130 is supportable by a support surface 144 of a second rigid member 140.

According to one aspect of the invention, the first resilient member 110 has a hardness greater than a hardness of the second resilient member 120. The relatively hard first resilient member 110 supported by the first rigid member 120 provides a relatively firm imprint surface against which the typeface 22 is impactably engageable for relatively improved accurate ink transfer from the inked ribbon onto the substrate. The second resilient member 130 has a relatively lesser hardness than the first resilient member 110 and is compressible between the first rigid member 120 and the second rigid member 140 for relatively improved absorption of shock from the typeface 22 impacting against the first resilient member 110 during imprinting. The backup pad assembly 100 thus provides a relatively firm imprint surface, which is required for accurate imprinting, and simultaneously provides relatively effective impact absorption, which extends the life of the backup pad assembly 100, particularly the first resilient member 110, and provides relatively improved imprinting consistency.

In one embodiment, the first resilient member 110 has a durometer hardness between approximately 80 and approximately 100, and the second resilient member 130 has a durometer hardness between approximately 20 and approximately 40. In an alternative embodiment, the first resilient member 110 has a durometer hardness between approximately 85 and approximately 95, and the second resilient member 130 has a durometer hardness between approximately 25 and approximately 35. And in yet another alternative embodiment, the first resilient member 110 has a durometer hardness of approximately 90, and the second resilient member 130 has a durometer hardness of approximately 30. In one embodiment, the first resilient member 110 is a silicone rubber material, and the second resilient member 130 is a cellular urethane material. And the first rigid member is an aluminium material. Other materials with similar properties may also be used. In the exemplary embodiment, the second resilient member 130 has approximately the same thickness as the combined thickness of the first resilient member 110 and the first rigid member 120. And in another embodiment, the second rigid member 140 is part of a larger mounting bar with a recess for receiving the first resilient member 110, the first rigid member 120 and the second resilient member 130.

Figure 3A:
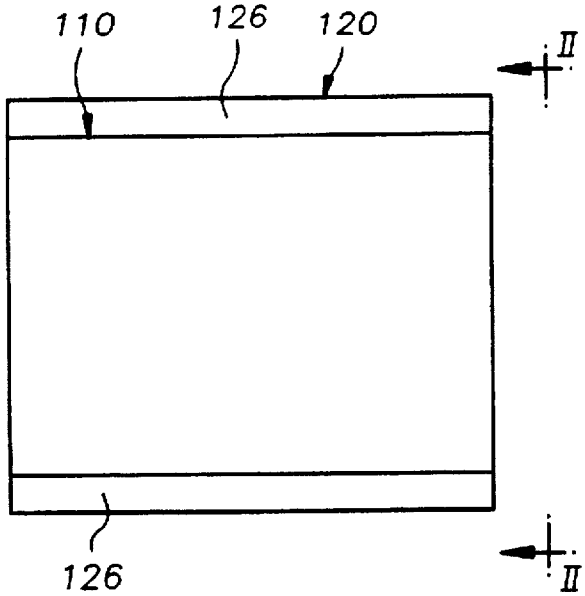
FIG. 3*a* is a plan view of a portion of a backup pad assembly according to an exemplary embodiment of the invention.
Figure 3B:
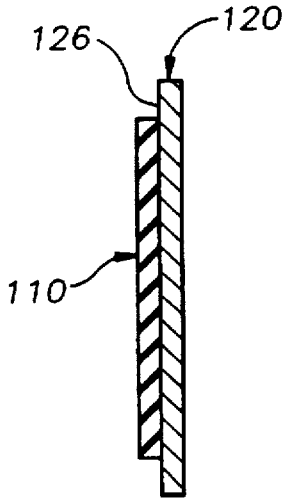
FIG. 3*b* is a side view taken along lines II—II of FIG. 3*a*.

According to another aspect of the invention, the backup pad assembly 100 includes one ore more clips 150 engageable to couple the first resilient member 110, the first rigid member 120 and the second resilient member 130 with the second rigid member 140. In the exemplary embodiments of FIGS. 1 and 2, a clip 150 includes a flange portion 152 extending over and engageable with corresponding opposing edge portions 126 of the first rigid member 120. The clips 150 are mountable to the second rigid member 140 by bolts 40 or other fastening means and retain the first rigid member 120 and the second resilient member 130 on the second rigid member 140. FIGS. 3*a* and 3*b* show the first resilient member 110 having a reduced lateral dimension relative to the first rigid member 120, which defines the opposing edge portions 126. The first resilient member 110 is bonded to the first rigid member 120. According to this configuration, the bonded first resilient member 110 and the first rigid member 120 are moveable toward the second rigid member 140 unimpeded by the clips 150, wherein shock resulting from the typeface impacting on the exposed surface 112 is absorbed by compressing the second resilient member 130 between the first rigid member 120 and the second rigid member 140.

According to another aspect of the invention, the clips 150 include slots 154 for ready installation of the clip 150 over partially installed fastening members 40. The slots 154 also permit adjusting the plane of the exposed surface 112 relative to the typeface 22 by depressing one or more sides of the clip 150 to slightly compress the second resilient member 120 before finally securing the fastening member 40.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. An imprinting system with a typeface for transferring ink from an inked ribbon onto a substrate, the system comprising:

a first resilient plate member having an exposed planar surface and a substantially opposing mounting surface, the exposed planar surface of the first resilient plate member located opposite the typeface, and the inked ribbon and substrate disposable between the typeface and the first resilient plate member:

a first rigid plate member having a support surface and a substantially opposing mounting surface, the support surface of the first rigid plate member supporting the mounting surface of the first resilient plate member;

a second resilient plate member having a support surface and a substantially opposing mounting surface, the support surface of the second resilient plate member supporting the mounting surface of the first rigid plate member; and a second rigid plate member having a support surface, the mounting surface of the second resilient plate member supported by the support surface of the second rigid plate member, the first resilient plate member has a hardness greater than a hardness of the second resilient plate member, and the second resilient plate member is compressible between the first rigid plate member and the second rigid plate member to absorb shock during imprinting.

2. The imprinting system of claim 1 wherein the first resilient plate member has a durometer hardness between approximately 80 and approximately 100, and the second resilient plate member has a durometer hardness between approximately 20 and approximately 40.

3. The imprinting system of claim 1 wherein the first resilient plate member has a durometer hardness between approximately 85 and approximately 95, and the second resilient plate member has a durometer hardness between approximately 25 and approximately 35.

4. The imprinting system of claim 1 wherein the first resilient plate member is a silicone rubber material, the first rigid plate member is a metal material, and the second resilient plate member is a cellular urethane material.

5. The imprinting system of claim 1 wherein a thickness of the second resilient plate member is substantially the same as a combined thickness of the first rigid plate member and the first resilient plate member.

6. The imprinting system of claim 5 wherein the first resilient plate member has a durometer hardness between approximately 80 and approximately 100, and the second resilient plate member has a durometer hardness between approximately 20 and approximately 40.

7. The imprinting system of claim 1 further comprising at least one clip engageable with an edge portion of the support surface of the first rigid plate member and connectable to the second rigid plate member for retaining the second resilient plate member between the second rigid plate member and the first rigid plate member, wherein the first resilient plate member is coupled to the first rigid plate member.

8. A backup pad useable for transferring of ink from an inked ribbon onto a substrate in an imprinting system, the backup pad comprising:

a first resilient plate member having an exposed planar surface and a substantially opposing mounting surface, the exposed surface of the first resilient plate member locatable opposite a typeface, and the inked ribbon and substrate disposable between the typeface and the first resilient plate member;

a first rigid plate member having a support surface and a substantially opposing mounting surface, the support surface of the first rigid plate member supporting the mounting surface of the first resilient plate member;

a second resilient plate member having a support surface and a substantially opposing mounting surface, the support surface of the second resilient plate member supporting the mounting surface of the first rigid plate member; and a second rigid plate member having a support surface, the mounting surface of the second resilient plate member supported by the support surface of the second rigid plate member, the second resilient plate member is compressible between the first rigid plate member and the second rigid plate member.

9. The backup pad of claim 8 wherein a thickness of the second resilient plate member is substantially the same as a combined thickness of the first rigid plate member and the first resilient plate member, and wherein the first resilient plate member has a durometer hardness between approximately 80 and approximately 100, and the second resilient plate member has a durometer hardness between approximately 20 and approximately 40.

10. The backup pad of claim 8 further comprising at least one clip engageable with an edge portion of the support surface of the first rigid plate member and connectable to the second rigid plate member for retaining the second resilient plate member between the second rigid plate member and the first rigid plate member, wherein the first resilient plate member is coupled to the first rigid plate member.

11. The backup pad of claim 10, the clip having a side portion with a slot, whereby the clip is adjustably connectable to the second rigid plate member with a fastener extendable through the slot in the side portion of the clip.

12. A method of transferring ink from an inked ribbon onto a substrate in an imprinting system with a typeface, the method comprising steps of:

impacting the typeface against an exposed planar surface of a first resilient plate member located opposite the typeface to transfer ink from the inked ribbon onto the substrate;

supporting the first resilient plate member with a first rigid plate member;

compressing a second resilient plate member disposed between the first rigid plate member and a second rigid plate member to absorb shock from the typeface impacting against the exposed surface of the first resilient plate member during imprinting; and retaining the second resilient plate member between the second rigid plate member and the first rigid plate member with at least one clip engageable with an ede portion of a support surface of the first rigid plate member and with the second rigid plate member.

* * * * *